United States Patent [19]

Glomski

[11] Patent Number: 4,836,394

[45] Date of Patent: Jun. 6, 1989

[54] REFUSE CONTAINER WITH TWO-POSITION LID

[75] Inventor: Norman J. Glomski, Chattanooga, Tenn.

[73] Assignee: The Heil Co., Milwaukee, Wis.

[21] Appl. No.: 192,002

[22] Filed: May 9, 1988

[51] Int. Cl.[4] ..... B65D 90/00

[52] U.S. Cl. ..... 220/1 T; 220/331; 220/335; 220/263; 220/334

[58] Field of Search ..... 220/1 T, 330, 331, 329, 220/334, 335, 263

[56] References Cited

U.S. PATENT DOCUMENTS

| | | | |
|---|---|---|---|
| 1,019,198 | 3/1912 | Spears | 220/335 |
| 3,422,988 | 7/1967 | La Franca | 220/331 |
| 4,148,411 | 4/1979 | Hodge | 220/1 T |

*Primary Examiner*—Stephen Marcus
*Assistant Examiner*—Gilbert W. Reece
*Attorney, Agent, or Firm*—Paul R. Puerner

[57] ABSTRACT

A refuse container has a two-position lid. The two positions are achieved by means of a J-shaped slot in a lid hinge. The slot receives a horizontal shaft supported in the container body. In the first open position, gravity acts on the lid such that the shaft is at one end of the slot, and the lid hinge abuts a pad on the container body for maintaining the lid at an angle of approximately 105° from a horizontal closed position. To pivot the lid to the second open position, the lid is lifted such that the slot slides over the shaft until the hinge clears the container body pad, at which point the lid is pivotable to approximately 270° with respect to the horizontal closed position.

5 Claims, 2 Drawing Sheets

REFUSE CONTAINER WITH TWO-POSITION LID

BACKGROUND OF THE INVENTION

1. Field of the Invention

This invention pertains to covered containers, and more particularly to refuse containers compatible with automated and semi-automated handling equipment.

2. Description of the Prior Art

Various types of large but transportable containers have been developed for handling refuse and other materials. Typical prior containers include an open-top container body, a lid, and wheels for rolling the container from place to place. The lid is usually pivotable on the container body between a closed position and an open position. In the closed position, the lid is generally horizontal and fits snugly over the open top of the container body. With the lid in the open position, the container body is uncovered for accepting refuse or other material.

To provide the pivotal connection between the container body and the lid, it is known to fabricate the container body with spaced ribs and the lid with hinge portions that mate with the ribs. A shaft extending through aligned apertures in the hinged portions and the ribs permits the lid to pivot between the open and closed positions. In the open position, the lid may attain an angle of about 105° with respect to the closed horizontal position The lid may be maintained in the open position by various means. In one prior design, a portion of the lid contacts the container body when the lid is at the open position, and gravity acts to maintain contact between the container body and the lid and thus hold the lid open.

U.S. Pat. No. 4,450,976 describes a container wherein the lid is manually operated between the closed and open positions. Some refuse containers are suitable for being handled by automated or semiautomated equipment. Such containers require some features that are not necessary on hand operated containers. Depending on the particular type of handling equipment used, the containers are designed with lids that are pivotable to different opened positions. With some handling equipment, the lids are openable only to a position of approximately 270° from the horizontal closed position. With other equipment, the covers are openable only to an angle of approximately 105°. It has been found desirable to develop a container that is suitable for use on all types of container handling equipment.

SUMMARY OF THE INVENTION

In accordance with the present invention, a versatile refuse container is provided that has a lid that is openable to two positions with respect to a horizontal closed position. This is accomplished by fabricating the lid with an elongated slot that rotatably receives a shaft mounted to a container body.

The container body is designed to hold a quantity of refuse or the like, and it may be generally conventional. The container body may have horizontally spaced ribs and a bar or shaft extending horizontally through the ribs. The exterior of the container body wall between the ribs is formed with a bumper or pad that projects from the container body wall. The lid is fabricated with a cover portion that fits over the container body to close it, as is known. The lid further comprises a hinge that extends beyond the cover portion and between the container body ribs. The slot in the hinge pivotally receives the shaft. With the lid closed, the slot extends generally horizontally. Preferably, the slot is J-shaped When the lid is closed, the hooked end of the J-shaped slot extends upwardly near the back end of the hinge, remote from the lid cover portion, and the shaft passes through the slot at the end of the slot leg adjacent the cover portion.

The arrangement of the container body pad, shaft, and lid hinge slot enables the lid to be pivoted on the shaft, with the shaft at the end of the leg of the J-shaped slot, through an angle of about 105° with respect to the closed horizontal position to the first open position. To locate the lid at the first open position, the lid hinge has a free edge that is dimensioned to contact the container body pad when the lid is in the first position and thereby restrain the lid against further rotation. With the lid in the first open position, gravity maintains the lid in place such that the shaft remains within the slot at the end of the slot leg.

To place the lid in the second open position, the lid is translated upwardly, such that the lid slot slides over the shaft until the shaft passes through the hooked end of the slot. With the lid in that position, the lid hinge free edge clears the container body pad, and the lid is able to be pivoted beyond the first position and swung to approximately a vertical attitude, thus being approximately 270°. from the closed horizontal position.

Other advantages, benefits, and features of the invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
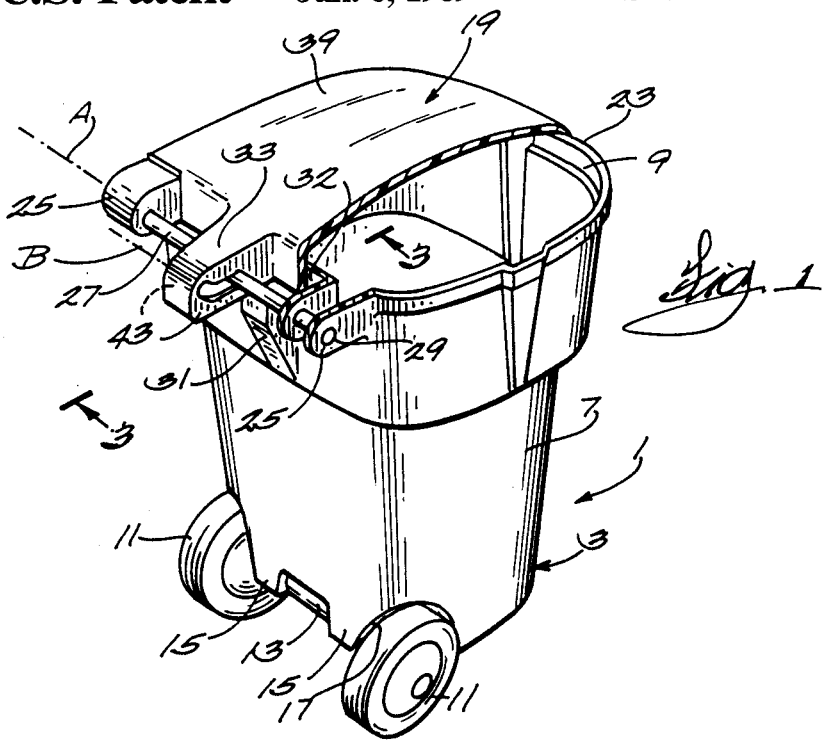
FIG. 1 is a partially broken perspective view of the refuse container of the present invention.
Figure 2:
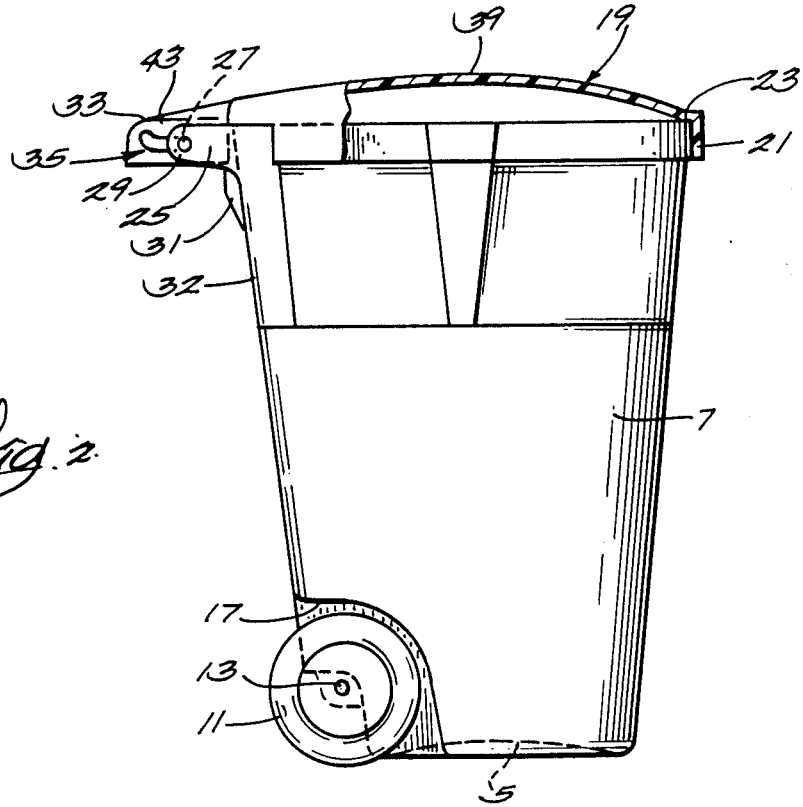
FIG. 2 is a side view, partially in section, of the refuse container of the present invention.

Referring to FIGS. 1 and 2, a large covered container 1 is illustrated that includes the present invention. The container 1 is particularly useful for collecting and temporarily storing refuse and similar material, but it will be understood that the invention is not limited to sanitary applications.

The container 1 comprises a hollow container body 3 that is preferably manufactured from a tough plastic material. The container body 3 has a floor 5 and circumferential upstanding walls 7. The top end 9 of the container body is open, and the walls 7 terminate in a top edge 23. The particular container body illustrated is provided with a pair of wheels 11 that are supported on an axle 13. The axle 13 is mounted in ridges 15 molded into the container body. The axle may be retained in the ridges 15 by any suitable means. To conserve space and to provide a neat appearance to the container, the wheels 11 may be recessed into wheel wells 17 molded into the container body.

In accordance with the present invention, the container 1 includes a two-position lid 19 that is pivotally connected to the container body 3. When in the closed position of FIGS. 1 and 2, the lid 19 forms a closure that fits over the container body open end 9. In addition to the closed position, the lid is pivotable on the container body to be selectively maintained in positions of approximately 105° and 270° with respect to the closed position, as will be explained. The lid has a cover portion 39 that is bounded by a downwardly extending lip 21. When the lid is closed, the cover portion lip 21 overlaps the top edge 23 of the container body.

To pivotally support the lid 19, the container body 3 is fabricated with a pair of horizontally spaced ribs 25 that extend rearwardly from the container back wall 32 near the top end 9. The ribs 25 define aligned apertures for receiving a shaft 27. The shaft 27 may be retained in the ribs by any suitable means, such as caps 29. Approximately midway between the ribs is a pad 31 that may be molded integrally with the container body and that projects rearwardly beyond the back wall 32.

To pivotally connect the lid 19 to the container body 3, the lid is formed with at least one hinge 33 integrally joined to the back side of the cover portion 39. Looking also at FIG. 3, the hinge 33 includes a top section 37 that blends smoothly as a continuation of the lid cover portion 39. The hinge top section 37 bends downwardly approximately 90 to terminate in a free edge 41. A pair of spaced vertical plates 43 depend from the lid hinge outboard of the container body back wall 32 and under the hinge top section 37. The plates 43 define respective aligned elongated slots 35. In the preferred embodiment, the slots 35 have generally J-shapes The slots extend between a first axial center line A near the lid cover portion and a second axial center line B that is remote from the lid cover portion and that is displaced vertically above the first center line A when the lid is in the closed horizontal position With the lid in place on the container body in the closed position of FIGS. 1–3, the shaft 27 is concentric with the slot center line A.

Figure 3:
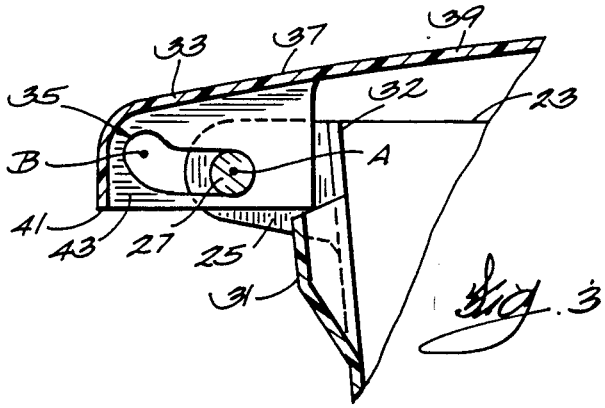
FIG. 3 is an enlarged cross sectional view taken along lines 3—3 of FIG. 1 showing the pivotal connection between the container body and the lid with the lid in the closed position.
Figure 4:
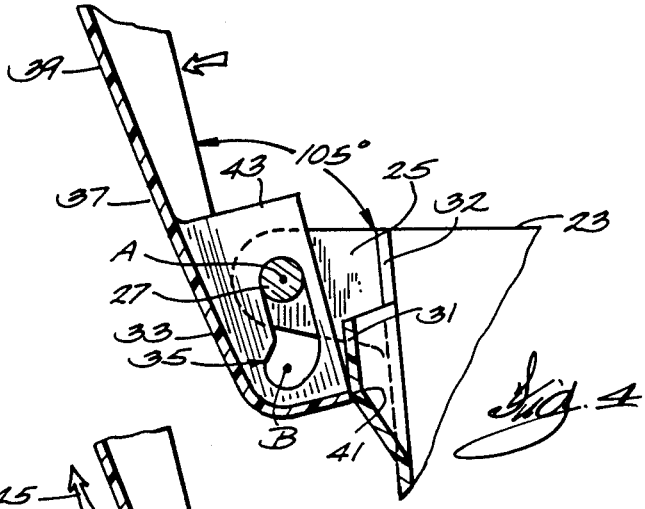
FIG. 4 is an enlarged cross sectional view similar to FIG. 3, but showing the pivotal connection between the container body and the lid with the lid in the first open position.

To pivot the lid 19 to the first open position, the lid is rotated counterclockwise with respect to FIGS. 1–3 about the shaft 27 with the shaft remaining in slot center line A. Turning to FIG. 4, the lid is shown in the first open position, where it makes an angle of approximately 105° to 110° with the top edge 23 of the container body 3. At that point, the hinge free edge 41 abuts the container body pad 31. Gravity forces the slot center line A to remain concentric with the shaft, thereby enabling continued cooperation between the hinge free edge and the container body pad to maintain the lid in the first open position.

Figure 5:
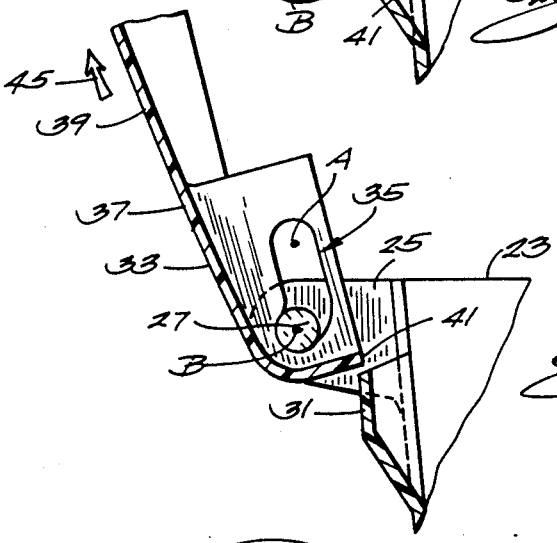
FIG. 5 is an enlarged cross sectional view similar to FIGS. 3 and 4, but showing the pivotal connection between the container body and the lid with the lid lifted vertically relative to the container body.
Figure 6:
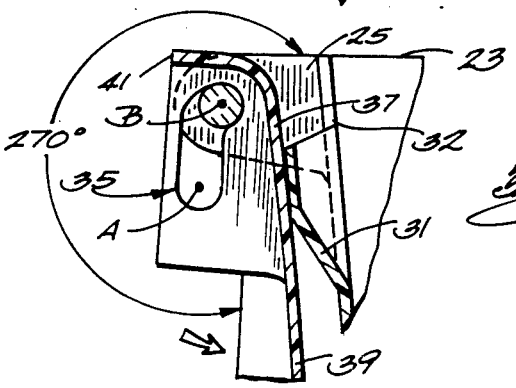
FIG. 6 is an enlarged cross sectional view similar to FIGS. 3–5, but showing the pivotal connection between the container body and the lid with the lid in the second open position.

Next turning to FIG. 5, the lid 19 is shown in a position intermediate the first and second open positions To pivot the lid from the first position of FIG. 4 to the second open position, it is first necessary to lift the lid in the direction of arrow 45. By doing so, the lid slot 35 slides over the shaft 27 until the slot center line B coincides with the shaft. When that has occurred, the lid hinge free edge 41 is raised above the container body pad 31. Consequently, the lid is clear to pivot counterclockwise to the second open position, FIG. 6 In the second position, the lid has pivoted through an angle of approximately 270° from the closed position of FIGS. 1–3.

To reclose the container 1 from the second open position, the lid 19 is pivoted clockwise about the shaft 27 with the shaft being concentric with slot center line B. Gravity causes the slot center line B to remain engaged with the shaft until the lid has been rotated to approach the intermediate position of FIG. 5. At that point, gravity causes the lid to slide downwardly over the shaft until the slot center line A is concentric with the shaft, and the lid is in the position of FIG. 4. From that position, additional clockwise pivoting will completely close the lid onto the container body.

Thus, it is apparent that there has been provided, in accordance with the invention, a refuse container with a two-position lid that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations that fall within the spirit and broad scope of the appended claims.

I claim:

1. A container comprising:

a. an open top container body having a back wall and adapted to hold a quantity of refuse or the like, the container body being formed with spaced ribs extending from the back wall near the open top;

b. a shaft retained within and extending between the container body ribs at a location spaced from the container body back wall; and c. lid means pivotally fixed to the shaft for being selectively pivoted between a closed position wherein the lid means covers the container body open top and first open position wherein the lid means cooperates with the container body to be maintained at a first predetermined angle relative to the closed position and a second open position wherein the lid means is maintained at a second predetermined angle with respect to the closed position, the lid means comprising:

i. a cover portion adapted to interfit over the container body open end; and ii. a hinge joined to the cover portion and extending therefrom and being generally coplanar therewith, the hinge being generally coplanar with the container body ribs when the cover portion is pivoted to the closed position, the hinge defining an enclosed elongated slot therethrough for pivotally receiving the shaft, the slot being generally coplanar with the plane of the hinge.

2. The cover of claim 1 wherein the hinge slot has a generally J-shape with a hooked first end remote from the cover portion and defined by a first axial center line that is concentric with the shaft when the lid means is in the closed position and in the first open position, and a second end defined by a second axial center line that is concentric with the shaft when the lid means is in the second open position, the slot first axial center line being located between the slot second axial center line and the lid means cover portion.

3. The refuse container of claim 1 wherein:

a. the container body comprises a pad projecting from the back wall proximate the ribs; and b. the lid hinge defines a free edge that is adapted to abut the container body pad when the lid is pivoted from the closed position to the first open position to thereby locate the lid in the first open position.

4. A container with a two-position lid comprising:

a. an open top container body having a back wall with a pair of spaced ribs extending therefrom and having a pad projecting therefrom adjacent the ribs;

b. a lid having a cover portion adapted to close the container body open top and a hinge joined to and extending from and being generally coplanar with the cover portion, the hinge being formed with a free edge and defining an enclosed generally J-shaped slot therethrough, the J-shaped slot defining first and second axial center lines with the first axial center line being located between the second axial center line and the cover portion; and c. a shaft received in the container body ribs and spaced from the container body back wall and passing through the slot first axial center line to permit pivoting the lid on the shaft from a closed position wherein the lid cover portion closes the container body open top to a first open position where the lid free edge abuts the container body pad to define an angle of approximately 105° with respect to the lid closed position the haft being slidable in the hinged slot to pass through the second axial center line to permit pivoting the lid from the first open position to the second open position.

5. The container of claim 4 wherein the lid hinge slot first and second axial center lines are spaced apart such that the lid hinge free edge clears the container body pad when the shaft passes through the hinge slot second axial center line, so that the lid can be pivoted about the shaft to the second open position when the shaft passes through the slot second axial center line.

* * * * *